United States Patent [19]

Hirota

[11] 4,204,617

[45] May 27, 1980

[54] TWO BOTTLE CARRIER

[75] Inventor: Kashichi Hirota, Hachioji, Japan

[73] Assignee: Kyowa Electric & Chemical Co., Ltd., Hachioji, Japan

[21] Appl. No.: 887,776

[22] Filed: Mar. 17, 1978

[51] Int. Cl.[2] ..... B65D 71/00

[52] U.S. Cl. ..... 224/45 A; 206/510

[58] Field of Search ..... 224/45 BA, 45 AB, 45 A, 224/48 F; 206/203, 201, 505, 506, 510, 509, 514, 515, 518, 519, 141, 162, 143, 139; 220/21, 23.4

[56] References Cited

U.S. PATENT DOCUMENTS

| | | | |
|---|---|---|---|
| 430,255 | 6/1890 | Schlereth et al. | 206/201 |
| 2,212,476 | 8/1940 | Kielberg | 206/519 |
| 2,404,699 | 7/1946 | Edgerton | 206/201 |
| 3,045,863 | 7/1962 | De Chelbor | 206/201 |
| 3,349,958 | 10/1967 | Breneman | 206/201 |
| 3,587,915 | 6/1971 | Theobald et al. | 206/510 |
| 3,991,879 | 11/1976 | Hirota | 206/510 |
| 4,040,517 | 8/1977 | Torokvei | 206/510 |
| 4,079,077 | 3/1978 | David | 206/518 |

*Primary Examiner*—Kenneth W. Noland

*Attorney, Agent, or Firm*—Newton, Hopkins & Ormsby

[57] ABSTRACT

A unitized molded plastic carrier for paired bottles or other containers features an over the top handle for lifting and carrying and a separator partition for the bottle receiving compartments of the carrier which materially strengthens the construction. The carrier may be nested telescopically with identical carriers within a minimum vertical space and plural carriers are receivable in a parent carrying case. A strong and economical carrier utilizing a minimum of moldable material is provided.

11 Claims, 6 Drawing Figures

TWO BOTTLE CARRIER

BACKGROUND OF THE INVENTION

Carriers for bottles, cans and the like with overtop integral handles are known in the prior art. Some pertinent examples of the prior art are the following U.S. Pat. Nos. 2,575,612; 2,821,327; 3,184,148; 3,283,947; 3,587,915; 3,891,084; 3,991,879.

The objective of this invention is to satisfy the ever-present need for a more economical, lightweight, sturdy and convenient carrier for bottles and the like and to improve on the known prior art in endeavoring to satisfy this need.

SUMMARY OF THE INVENTION

A unitized molded plastic two bottle carrier possesses side-by-side bottle cells formed by rectangular leg arrays with the tops of the legs interconnected by a continuous marginal frame. Opposing webs of paired interior legs are extended above said frame and joined at their tops by a transverse web constituting an over-top carrying handle at the center of the carrier.

The bottoms of the two bottle cells of the carrier are formed by webs which are united at the bottoms of the legs and are upwardly recessed to facilitate stacking the carrier with an underlying filled carrier. A contoured divider partition between the two bottle cells materially strengthens the carrier in two directions without adding significantly to the amount of material utilized. The carrier is drafted for telescopic stacking with other like carriers in a minimum vertical space. Plural two bottle carriers, according to the invention, can be snugly disposed side-by-side in a parent carrying case with or without divider partitions.

DETAILED DESCRIPTION

Figure 2:
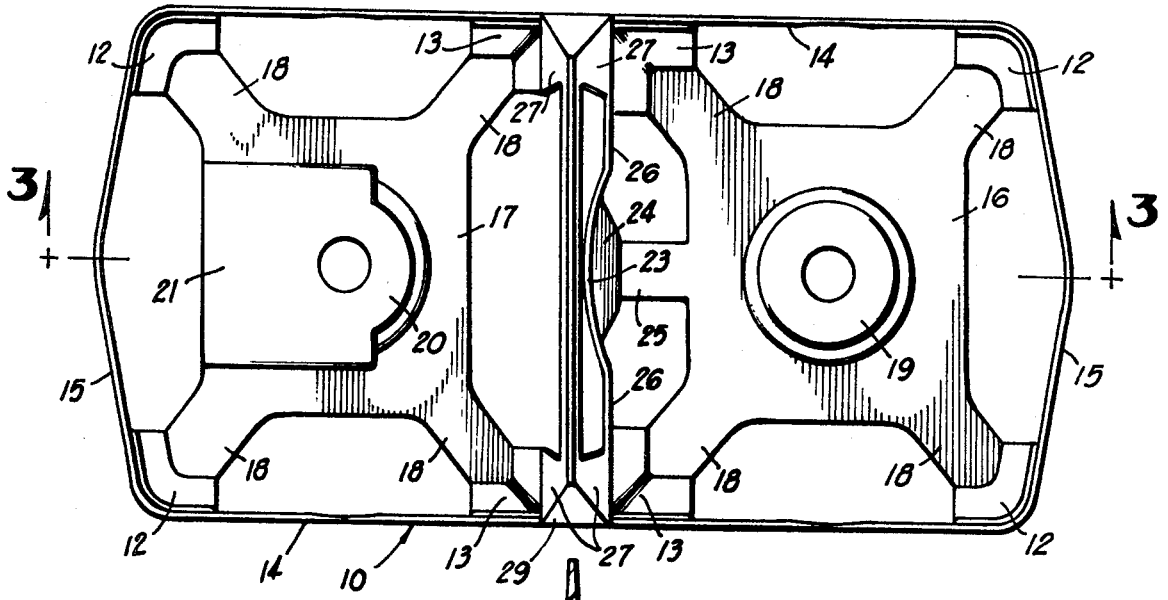
FIG. 2 is a plan view thereof.

Referring to the drawing in detail wherein like numerals designate like parts, a two bottle carrier embodying the invention is shown in its entirety at 10 and is formed as an integral unit by molding from plastics by techniques well known in the art. The two bottle carrier 10 as viewed from the top, FIG. 2, is roughly rectangular and elongated to form two side-by-side cells for a pair of large bottles 11 or other types of containers. Each of the two cells is formed by a rectangular array of paired outer and inner les 12 and 13 of roughly right angular cross sectional shape and being somewhat tapered downwardly. As shown in FIG. 2, the outer paired legs 12 have rounded generally vertical corners while the inner paired legs 13 are more nearly right angular in cross section.

The tops of the legs 12 and 13 are integrally joined to an upper continuous marginal frame 14, also of generally rectangular form, but including end transverse bars 15 which are bowed outwardly in a symmetrical manner as shown in FIG. 2.

The bottoms of the two bottle cells are defined by generally rectangular webs 16 and 17 whose corners are joined by four extensions 18 to the bottoms of the legs 12 and 13 integrally.

The webs 16 and 17 have upwardly stepped recesses 19 and 20 in their bottoms to facilitate stacking the two bottle carrier 10 with other filled carriers below it. The bottom recess 20 is semi-circular, FIG. 2, while the recess 19 is circular. A flat somewhat inclined wall 21 extends outwardly from the semi-circular recess 20 to one edge of the web 17 and this wall forms a mounting surface for inventory control and/or price indicia labels or the like.

To further separate the two bottle cells of the carrier, a roughly T-shaped divider 22 spans the carrier at its center including a transverse top bar 23 which is arched or bowed so as to locate the top of the divider 22 squarely at the center of the carrier or midway between the two frame ends 15. A center leg 24 of the divider 22 extends to the bottom of the carrier and is inclined in approximate parallelism to the taper of the legs 13 and joined to the lower web 16 by a short horizontal extension 25 substantially at right angles thereto. In addition to separating or dividing the cells of the carrier so that the two bottles 11 will not come into contact, the divider materially strengthens the carrier by providing a sturdy crossbrace near the top and longitudinal center thereof. The opposite end portions 26 of the bar 23 are joined integrally to the legs 13 of one bottle cell, namely, the cell having the bottom web 16.

Figure 1:
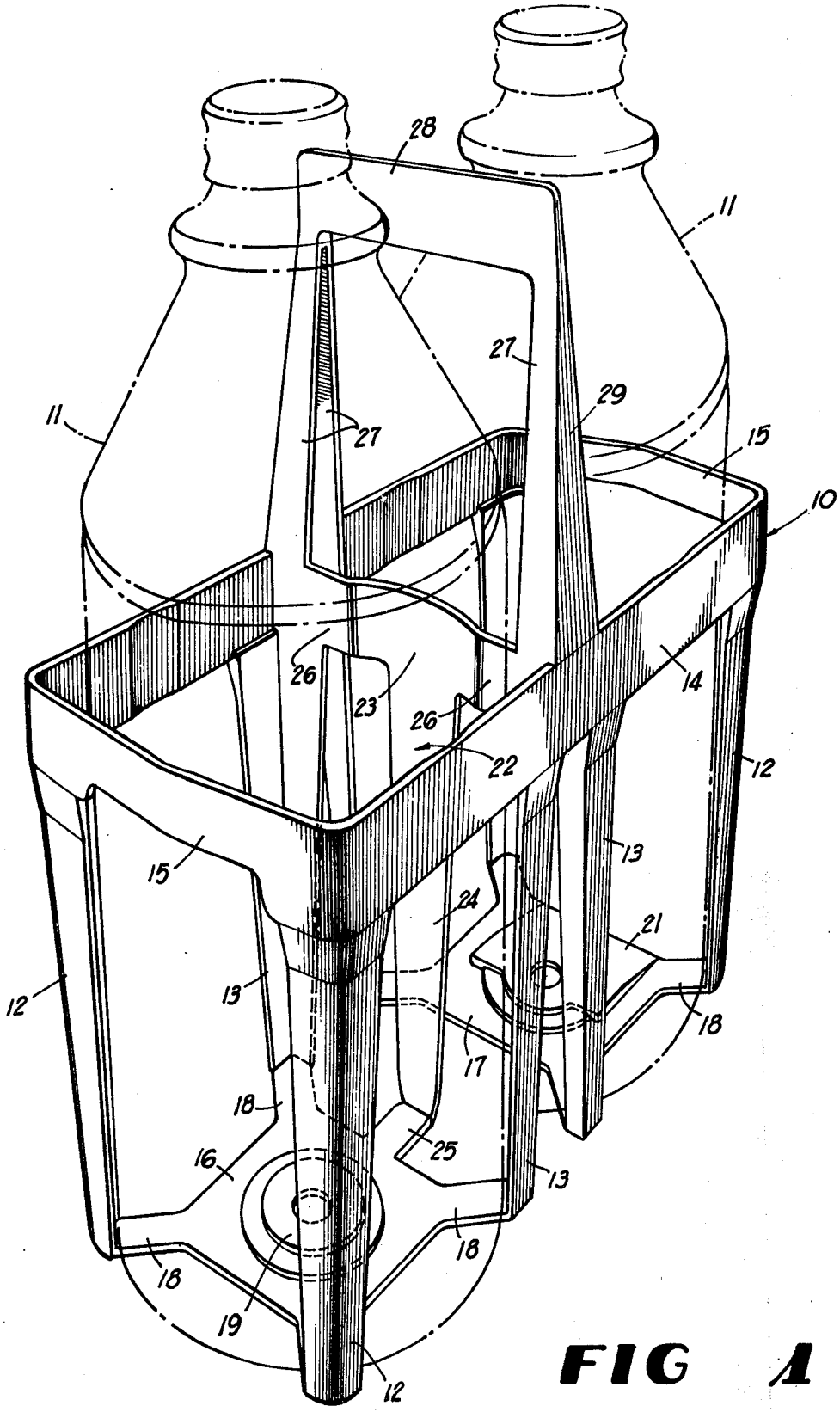
FIG. 1 is a perspective view of a two bottle carrier embodying the invention.
Figure 3:
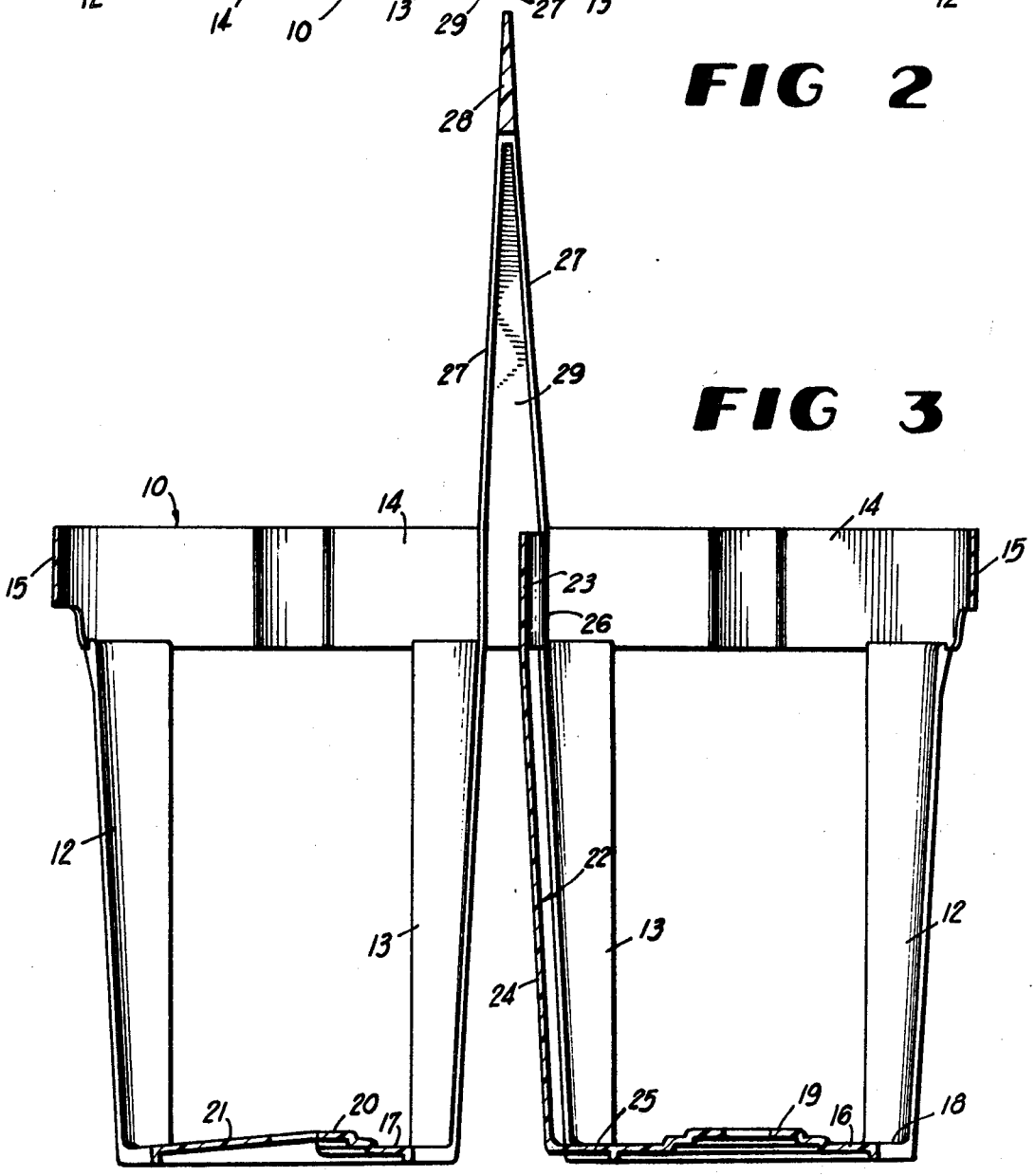
FIG. 3 is a vertical section through the carrier taken on line 3—3 of FIG. 2.
Figure 5:
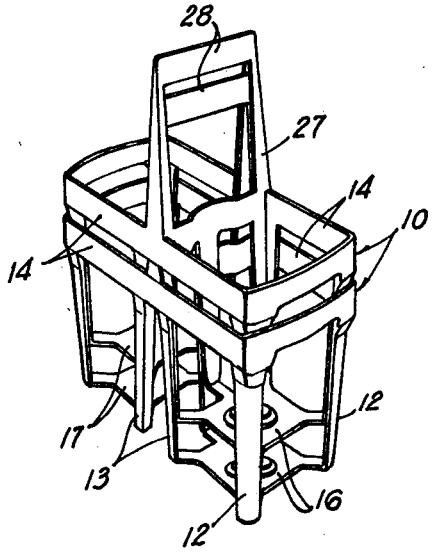
FIG. 5 is a perspective view of nested carriers according to the invention.
Figure 6:
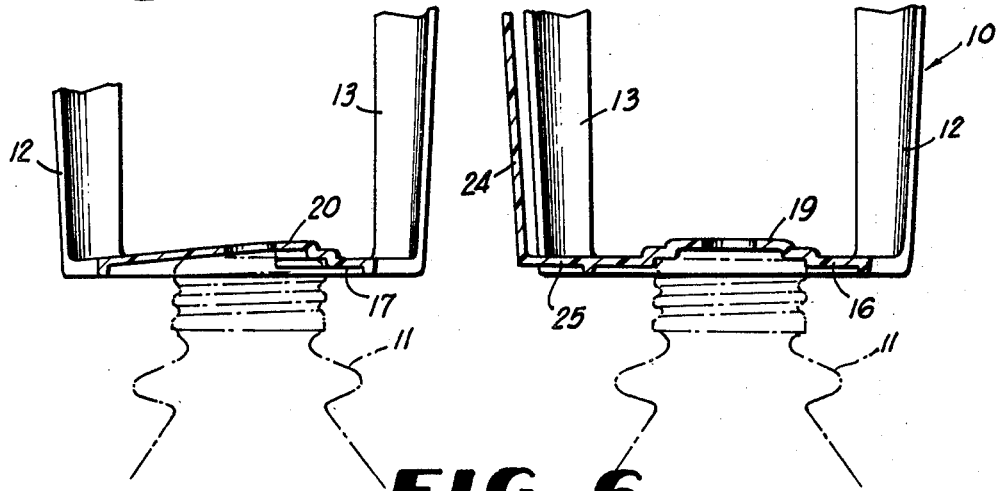
FIG. 6 is a fragmentary cross section similar to FIG. 3 illustrating the stackability of the carrier with another filled carrier therebelow.

Above the T-shaped divider 22 and marginal frame 14, gradually upwardly converging paired web extensions 27 of the interior legs 13 extend for a substantial distance above the frame 14 and are integrally joined by a crossbar 28 forming a convenient over-top lifting and carrying handle for the two bottle carrier at its center. The converging webs 27 are integrally joined above the frame 14 by outer upwardly tapering walls 29 whose lower ends are joined into the frame 14 as clearly shown in FIG. 1. In effect, the web 27 and walls 29 form hollow channel-like arms to which the handle 28 is attached at the top thereof. The tapering hollow nature of the two handle support arms and the gradual divergence of the interior legs 13, FIG. 3, along with the downward draft of the bottle cells renders the two bottle carrier 10 readily nestable or stackable telescopically with other like carriers as illustrated clearly in FIG. 5 of the drawings. As shown in FIG. 5, the carriers are nested by telescoping the roughly rectangular cells of two or more carriers, in the manner shown. When this is done, the over-top handles telescope or nest due to the above-described hollow construction of the handle arms.

Figure 4:
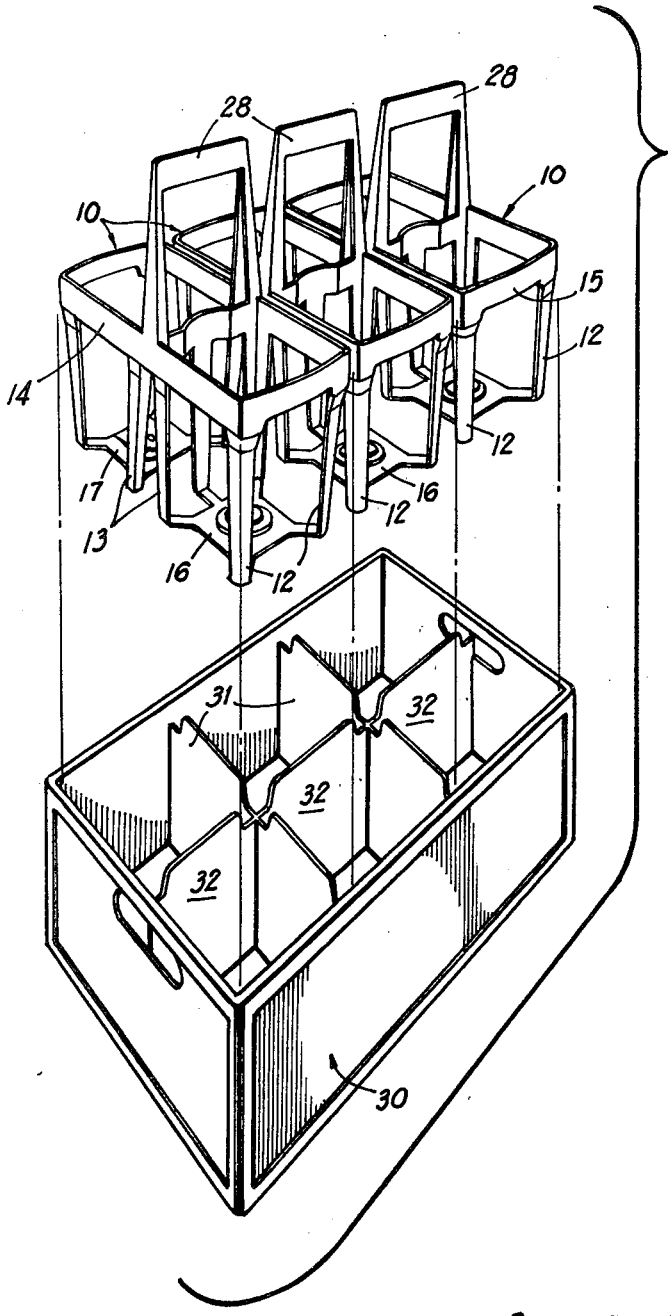
FIG. 4 is an exploded perspective view of plural two bottle carriers and a parent crate or case for the same.

As shown in FIG. 4, three of the carriers 10 may be received side-by-side in a rectangular carrying box or case 30 having transverse and longitudinal dividers 31 and 32 forming six rectangular cells in the crate. The rectangular bottle cells of the carriers 10 can enter the compartments or cells of the case 30 and the dividers 31 and 32 will simply enter between the legs 12 and 13 of the three carriers, as should be readily apparent. The two bottle carriers 10 are independently removable from or insertable into the parent case 30. The case dividers 31 and 32 are not absolutely necessary and may be dispensed with in some instances.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claims:

1. A carrier for a pair of container units comprising a continuous marginal frame of roughly rectangular configuration and being elongated, opposing pairs of legs depending from said frame near the opposite ends and longitudinal center thereof and forming rectangular arrays of legs with the arrays separated somewhat near the longitudinal center of said frame, bottom webs joined with the lower ends of the legs in said rectangular arrays of legs and forming with the arrays of legs and with said marginal frame a pair of discrete container unit cells, a substantially T-shaped divider separating said cells substantially at the longitudinal center of said frame and including a transverse upper bar joined with opposite sides of said frame and a generally vertical leg substantially at the transverse center of said frame joined at its lower end to one of said bottom webs, and an over-top handle for said carrier extending parallel to said transverse upper bar at the longitudinal center of said frame and having side arm portions joined to said frame and said T-shaped divider.

2. A carrier for a pair of container units as defined in claim 1, and all of said legs in said rectangular arrays being generally right angular in transverse cross section, and the pairs of legs near the longitudinal center of said marginal frame including webs which project inwardly from opposite sides of said frame and are joined integrally with the arms of said handle.

3. A carrier for a pair of container units as defined in claim 2, and said last-named webs being joined integrally with said transverse upper bar of the T-shaped divider.

4. A carrier for a pair of container units as defined in claim 2, and said side arm portions of said over-top handle being of channel cross-section and opening inwardly from the sides of said frame in opposing relationship and including channel webs which constitute integral continuations of said webs of the pairs of legs near the longitudinal center of said marginal frame.

5. A carrier for a pair of container units as defined in claim 4, and said discrete cells tapering downwardly whereby the cells are distinctly separated at their lower ends to form therebetween a comparatively narrow upwardly tapering passage, and said channel cross-section side arm portions of said handle defining on the carrier top continuations of said upwardly tapering passage.

6. A carrier as in claim 5 wherein said upwardly tapering passage and said continuation thereof are so proportioned that when two identical carriers are nested together by telescoping the cells thereof, the over-top handle of one carrier will be received in the passage and continuation of the other carrier.

7. A carrier for a pair of container units as defined in claim 1, and said bottom webs being upwardly recessed centrally to facilitate stacking plural filled carriers for pairs of container units one upon another.

8. A carrier for a pair of container units as defined in claim 1, and said discrete cells tapering downwardly somewhat whereby the cells are distinctly separated at their lower ends to form therebetween a comparatively narrow upwardly tapering passage.

9. A carrier for containers comprising a skeleton frame defining at least two side-by-side container cells, said frame including a top marginal portion and legs depending from the top marginal portion to define corners for said cells, bottom webs joined with the lower ends of the legs and forming bottom walls for the cells, a top-to-bottom divider joined with said top marginal portion and extending transversally of said top marginal portion and said divider is also joined with a bottom web substantially in the area adjacent to where the centers of the side-by-side container cells are aligned, and between said cells and separating said cells and preventing contact of containers within the side-by-side cells, and a top central handle for the carrier joined with the top marginal portion of said frame and being substantially parallel to said divider where the divider joins the top marginal portion, said carrying handle also being joined with the top of said divider.

10. A carrier for containers as defined in claim 9, and said bottom webs having the undersides upwardly recessed centrally and adapted to receive variable diameter bottle closures to promote stacking the carrier with other like carriers having containers in said cells.

11. A carrier for a pair of container units comprising a continuous marginal frame of roughly rectangular configuration and being elongated, opposing pairs of legs depending from said frame near the opposite ends and longitudinal center thereof and forming rectangular arrays of legs with the arrays separated somewhat near the longitudinal center of said frame, bottom webs joined with the lower ends of the legs in said rectangular arrays of legs and forming with the arrays of legs and with said marginal frame a pair of discrete container unit cells, a substantially T-shaped divider separating said cells substantially at the longitudinal center of said frame and including a transverse upper bar joined with opposite sides of said frame and a generally vertical leg substantially at the transverse center of said frame joined at its lower end to one of said bottom webs, and an over-top handle for said carrier at the longitudinal center of said frame and having side arm portions joined to said frame and said T-shaped divider, said marginal frame including frame ends which are bowed outwardly, and said transverse upper bar of the T-shaped divider being bowed roughly in parallelism with one of said frame ends.

* * * * *